US012656012B2

(12) United States Patent
Tsuji

(10) Patent No.: US 12,656,012 B2
(45) Date of Patent: Jun. 16, 2026

(54) AIR CONDITIONING CONTROL APPARATUS AND AIR CONDITIONING SYSTEM

(71) Applicant: DAIKIN INDUSTRIES, LTD., Osaka (JP)

(72) Inventor: Yoshiyuki Tsuji, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 336 days.

(21) Appl. No.: 18/370,133

(22) Filed: Sep. 19, 2023

(65) Prior Publication Data

US 2024/0003579 A1 Jan. 4, 2024

Related U.S. Application Data

(63) Continuation of application No. PCT/JP2022/015647, filed on Mar. 29, 2022.

(30) Foreign Application Priority Data

Mar. 31, 2021 (JP) ..... 2021-061277

(51) Int. Cl.
*F24F 11/72* (2018.01)
*F24F 11/62* (2018.01)
*F24F 110/10* (2018.01)

(52) U.S. Cl.
CPC ..... *F24F 11/72* (2018.01); *F24F 11/62* (2018.01); *F24F 2110/10* (2018.01)

(58) Field of Classification Search
CPC ..... F24F 11/72; F24F 11/62; F24F 2110/10
See application file for complete search history.

(56) References Cited

U.S. PATENT DOCUMENTS

2005/0097905 A1 5/2005 Kwon et al.
2021/0254851 A1* 8/2021 Taguchi ..... G05B 13/0265
2022/0170659 A1 6/2022 Kitagawa et al.

FOREIGN PATENT DOCUMENTS

EP 2 206 985 A2 7/2010
JP H0533769 A * 2/1993
JP 5-312378 A 11/1993
JP 7-27395 A 1/1995
JP 7-35388 A 2/1995
(Continued)

OTHER PUBLICATIONS

Okada et al., Air Conditioner, Nov. 16, 2001, JP2001317791A, Whole Document (Year: 2001).*
(Continued)

*Primary Examiner* — Larry L Furdge
(74) *Attorney, Agent, or Firm* — Birch, Stewart, Kolasch & Birch, LLP

(57) ABSTRACT

An air conditioning control apparatus controls a plurality of indoor units. The air conditioning control apparatus sets the indoor units having been designated among the plurality of indoor units as one group. The air conditioning control apparatus causes a first indoor unit belonging to the group to perform a cooling operation or a heating operation and causes a second indoor unit belonging to the group to perform a fan operation or a ventilation operation when a difference of a certain level or more occurs in thermal loads to be processed by each of the indoor units belonging to the group.

15 Claims, 7 Drawing Sheets

(56) References Cited

FOREIGN PATENT DOCUMENTS

| | | | | |
|---|---|---|---|---|
| JP | H0735388 | A | * | 2/1995 |
| JP | 2001059639 | A | * | 3/2001 |
| JP | 2001317791 | A | * | 11/2001 |
| JP | 2005-3357 | A | | 1/2005 |
| JP | 2011-163732 | A | | 8/2011 |
| JP | 2012-220036 | A | | 11/2012 |
| JP | 2014-238215 | A | | 12/2014 |
| JP | 2015-21719 | A | | 2/2015 |
| JP | 2016-156511 | A | | 9/2016 |
| JP | 2021-32479 | A | | 3/2021 |
| KR | 10-2018-0090913 | A | | 8/2018 |

OTHER PUBLICATIONS

Kizawa, Controller for Air Conditioner, Feb. 7, 1995, JPH0735388A, Whole Document (Year: 1995).*

Hitoshi et al., Air Conditioner, Mar. 6, 2001, JP2001059639A, Whole Document (Year: 2001).*

Otani et al., Air Blowing Device With Timer, Feb. 9, 1993, JPH0533796A, Whole Document (Year: 1993).*

International Search Report, issued in PCT/JP2022/015647, PCT/ISA/210, dated Jun. 7, 2022.

Written Opinion of the International Searching Authority, issued in PCT/JP2022/015647, PCT/ISA/237, dated Jun. 7, 2022.

International Preliminary Report on Patentability and English translation of the Written Opinion of the International Searching Authority dated Oct. 12, 2023 for Application No. PCT/JP2022/015647.

Extended European Search Report for European Application No. 22780976.1, dated Aug. 28, 2024.

* cited by examiner

AIR CONDITIONING CONTROL APPARATUS AND AIR CONDITIONING SYSTEM

CROSS REFERENCE TO RELATED APPLICATIONS

This application is a Continuation of PCT International Application No. PCT/JP2022/015647, filed on Mar. 29, 2022, which claims priority under 35 U.S.C. § 119(a) to Patent Application No. JP 2021-061277, filed in Japan on Mar. 31, 2021, all of which are hereby expressly incorporated by reference into the present application.

TECHNICAL FIELD

The present invention relates to an air conditioning control apparatus and an air conditioning system.

BACKGROUND ART

As disclosed in Patent Literature 1 (JP H05-312378 A), there is a technique for controlling a circulation amount of a refrigerant to be equal between indoor units when there is an extreme difference in a distribution ratio of the refrigerant between the indoor units in order to improve a non-uniform temperature distribution in a space.

SUMMARY

An air conditioning control apparatus according to a first aspect controls a plurality of indoor units. The air conditioning control apparatus sets the indoor units having been designated among the plurality of indoor units as an indoor unit group. The air conditioning control apparatus causes a first indoor unit belonging to the indoor unit group to perform a cooling operation or a heating operation and causes a second indoor unit belonging to the indoor unit group to perform a fan operation or a ventilation operation when a difference of a certain level or more occurs in thermal loads to be processed by each of the indoor units belonging to the indoor unit group.

DESCRIPTION OF EMBODIMENTS (1) Overall Configuration

Figure 1:
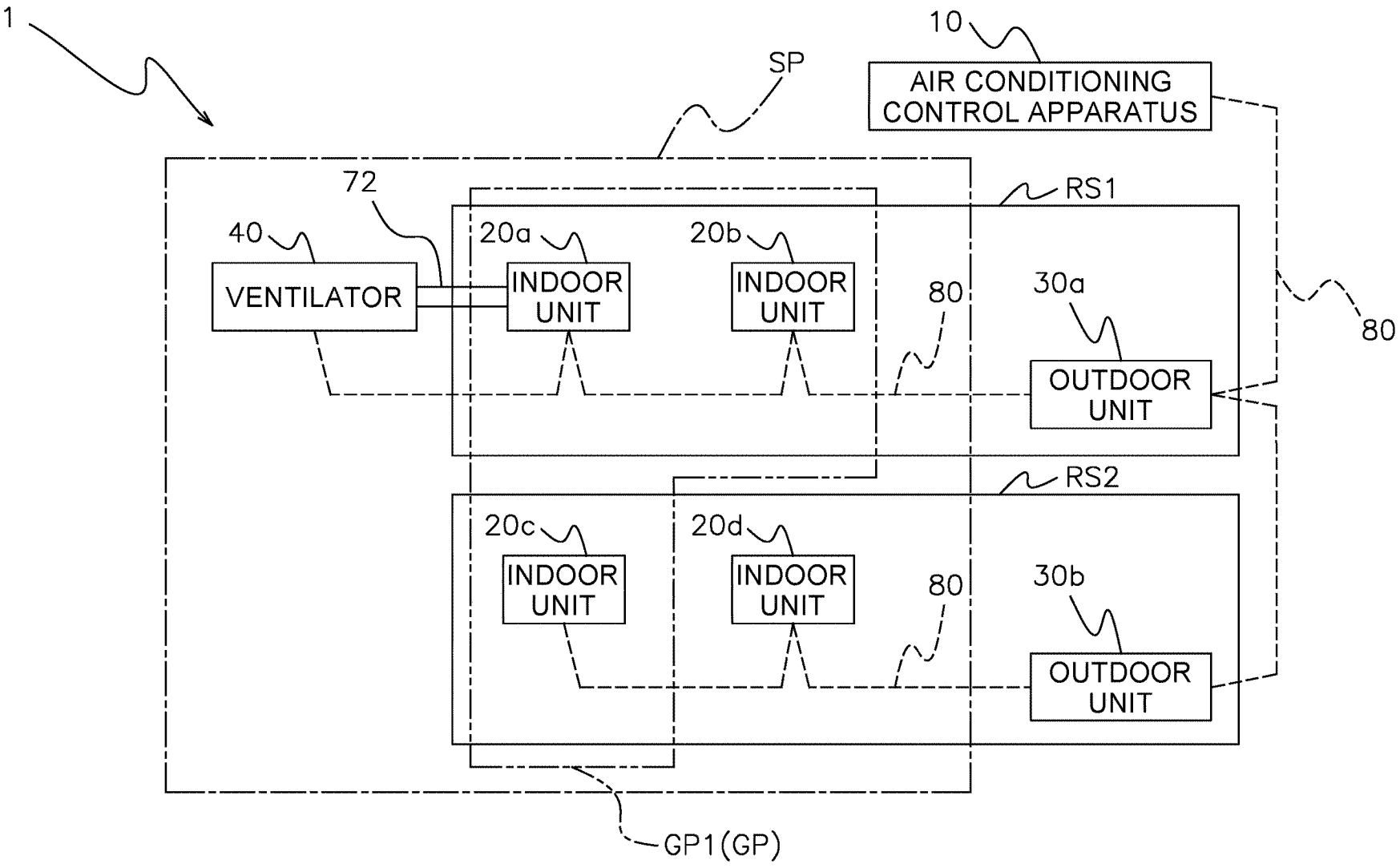
FIG. 1 is a schematic configuration diagram of an air conditioning system.

An air conditioning system 1 constitutes a vapor compression refrigeration cycle and performs air conditioning of a target space SP (space). In the present embodiment, the air conditioning system 1 is a so-called multi-air conditioning system for buildings. FIG. 1 is a schematic configuration diagram of the air conditioning system 1. As shown in FIG. 1, the air conditioning system 1 mainly includes an air conditioning control apparatus 10 and a plurality of indoor units 20*a* to 20*d*. The air conditioning system 1 includes outdoor units 30*a* and 30*b* and a ventilator 40. The indoor units 20*a* to 20*d*, the outdoor units 30*a* and 30*b*, and the ventilator 40 are installed in the target space SP.

The outdoor units 30*a* and 30*b* and the air conditioning control apparatus 10 are communicably connected by a communication line 80. The outdoor unit 30*a* is communicably connected to the indoor units 20*a* and 20*b* and the ventilator 40 via the communication line 80. The outdoor unit 30*b* is communicably connected to the indoor units 20*c* and 20*d* via the communication line 80.

Figure 2:
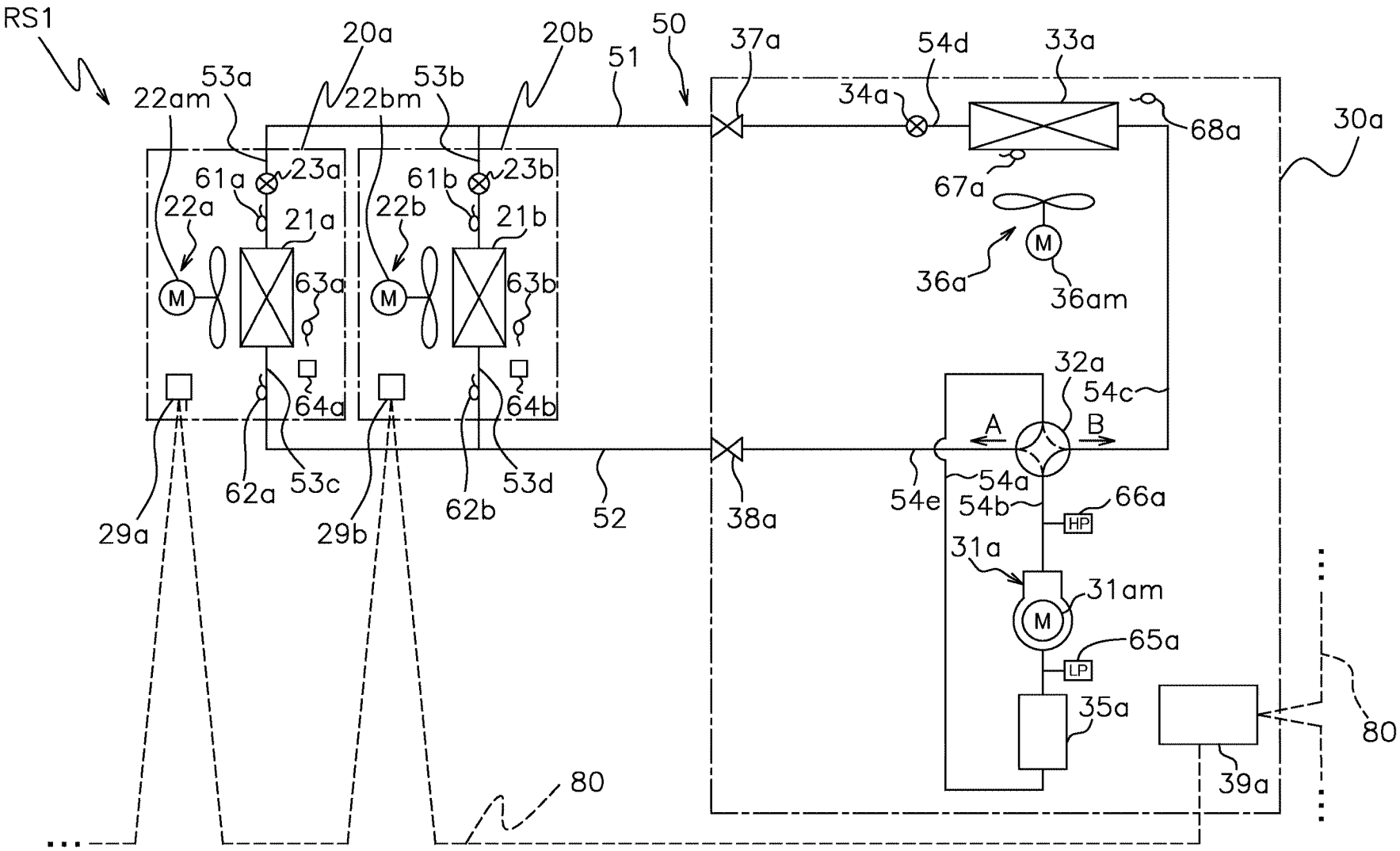
FIG. 2 is a diagram showing a refrigerant circuit of a refrigerant system.

The outdoor unit 30*a* and the indoor units 20*a* and 20*b* constitute a refrigerant system RS1. The outdoor unit 30*b* and the indoor units 20*c* and 20*d* constitute a refrigerant system RS2. FIG. 2 is a diagram showing the refrigerant system RS1 of a refrigerant circuit 50. As shown in FIG. 2, the outdoor unit 30*a* and the indoor units 20*a* and 20*b* are connected via a liquid refrigerant connection pipe 51 and a gas refrigerant connection pipe 52 to constitute the refrigerant circuit 50.

In the present embodiment, the indoor units 20*a* to 20*d* perform a cooling operation, a heating operation, a fan operation, or a ventilation operation. The cooling operation is an operation of cooling air in the target space SP. The heating operation is an operation of heating air in the target space SP. The fan operation is an operation of stirring or circulating the air in the target space SP. The ventilation operation is an operation of taking out indoor air RA from the target space SP and taking outdoor air OA into the target space SP by using the ventilator 40. In the present embodiment, the indoor unit 20*a* is connected to the ventilator 40 by an air supply duct 72. The indoor unit 20*a* can perform the ventilation operation in conjunction with the ventilator 40.

(2) Detailed Configuration

Hereinafter, the air conditioning control apparatus 10, the indoor units 20*a* and 20*b*, the outdoor unit 30*a*, and the ventilator 40 included in the air conditioning system 1 will be described in detail. The description of the indoor units 20*c* and 20*d* and the outdoor unit 30*b* is basically similar to the description of the indoor units 20*a* and 20*b* and the outdoor unit 30*a* except for the presence or absence of the ventilator 40, and thus, will be omitted unless otherwise necessary.

(2-1) Indoor Units

The indoor units 20*a* and 20*b* are installed in the target space SP in a building or the like. In the present embodiment, the indoor units 20*a* and 20*b* are ceiling embedded units to be installed in a ceiling. As shown in FIG. 2, the indoor units 20*a* and 20*b* mainly include indoor heat exchangers 21*a* and 21*b*, indoor fans 22*a* and 22*b*, indoor expansion valves 23*a* and 23*b*, indoor control units 29*a* and 29*b*, liquid-side temperature sensors 61*a* and 61*b*, gas-side temperature sensors 62*a* and 62*b*, indoor temperature sensors 63*a* and 63*b*, and human detection sensors 64*a* and 64*b*. As shown in FIG. 2, the indoor units 20*a* and 20*b* include liquid refrigerant pipes 53*a* and 53*b* that connect liquid-side ends of the indoor heat exchangers 21*a* and 21*b* and the liquid refrigerant connection pipe 51, and gas refrigerant pipes 53*c* and 53*d* that connect gas-side ends of the indoor heat exchangers 21*a* and 21*b* and the gas refrigerant connection pipe 52.

(2-1-1) Indoor Heat Exchangers

The indoor heat exchangers 21*a* and 21*b* are not limited in structure. For example, the indoor heat exchangers 21*a* and 21*b* are cross-fin type fin-and-tube heat exchangers that includes a heat transfer tube (not shown) and a large number of fines (not shown). The indoor heat exchangers 21*a* and 21*b* exchange heat between the refrigerant flowing through the indoor heat exchangers 21*a* and 21*b* and the indoor air RA in the target space SP.

The indoor heat exchangers 21*a* and 21*b* function as an evaporator during the cooling operation. The indoor heat exchangers 21*a* and 21*b* function as a condenser during the heating operation.

(2-1-2) Indoor Fans

The indoor fans 22*a* and 22*b* suck the indoor air RA into the indoor units 20*a* and 20*b*, supply the indoor air RA to the indoor heat exchangers 21*a* and 21*b*, and supply the indoor air RA subjected to heat exchange with the refrigerant in the indoor heat exchangers 21*a* and 21*b* to the target space SP. The indoor fans 22*a* and 22*b* are, for example, centrifugal fans such as turbo fans or sirocco fans. The indoor fans 22*a* and 22*b* are driven by indoor fan motors 22*am* and 22*bm*. The indoor fan motors 22*am* and 22*bm* have the number of rotations controllable by an inverter.

(2-1-3) Indoor Expansion Valves

The indoor expansion valves 23*a* and 23*b* are mechanisms for adjusting pressure and flow rate of the refrigerant flowing through the liquid refrigerant pipes 53*a* and 53*b*. The indoor expansion valves 23*a* and 23*b* are provided in the liquid refrigerant pipes 53*a* and 53*b*. In the present embodiment, the indoor expansion valves 23*a* and 23*b* are electronic expansion valves whose opening degrees are adjustable.

(2-1-4) Sensors

The liquid-side temperature sensors 61*a* and 61*b* measure a temperature of the refrigerant flowing through the liquid refrigerant pipes 53*a* and 53*b*. The liquid-side temperature sensors 61*a* and 61*b* are provided in the liquid refrigerant pipes 53*a* and 53*b*.

The gas-side temperature sensors 62*a* and 62*b* measure a temperature of the refrigerant flowing through the gas refrigerant pipes 53*c* and 53*d*. The gas-side temperature sensors 62*a* and 62*b* are provided in the gas refrigerant pipes 53*c* and 53*d*.

The indoor temperature sensors 63*a* and 63*b* measure a temperature of the indoor air RA in the target space SP. The indoor temperature sensors 63*a* and 63*b* are provided near suction ports of the indoor air RA of the indoor units 20*a* and 20*b*.

The liquid-side temperature sensors 61*a* and 61*b*, the gas-side temperature sensors 62*a* and 62*b*, and the indoor temperature sensors 63*a* and 63*b* are, for example, thermistors.

The human detection sensors 64*a* and 64*b* detect a person in the target space SP. The human detection sensors 64*a* and 64*b* are provided in front of the indoor units 20*a* and 20*b*. The human detection sensors 64*a* and 64*b* are, for example, human detection cameras or infrared sensors.

(2-1-5) Indoor Control Units

The indoor control units 29*a* and 29*b* control the operation of each component constituting the indoor units 20*a* and 20*b*.

The indoor control units 29*a* and 29*b* are electrically connected to various devices of the indoor units 20*a* and 20*b*, which include the indoor expansion valves 23*a* and 23*b* and the indoor fan motors 22*am* and 22*bm*. The indoor control units 29*a* and 29*b* are communicably connected to various sensors provided in the indoor units 20*a* and 20*b*, which include the liquid-side temperature sensors 61*a* and 61*b*, the gas-side temperature sensors 62*a* and 62*b*, the indoor temperature sensors 63*a* and 63*b*, and the human detection sensors 64*a* and 64*b*.

The indoor control units 29*a* and 29*b* include a control calculator and a storage device. The control calculator is a processor such as a CPU or a GPU. The storage device is a storage medium such as a RAM, a ROM, or a flash memory. The control calculator reads a program from the storage device and executes predetermined calculation processing in accordance with the program to control the operation of each component constituting the indoor units 20*a* and 20*b*. In addition, the control calculator is capable of writing a result of calculation to the storage device and reading information from the storage device in accordance with the program. The indoor control units 29*a* and 29*b* also include a timer.

The indoor control units 29*a* and 29*b* are configured to receive various signals from an operation remote controller (not shown). The various signals include, for example, signals instructing a start and a stop of an operation, and signals related to various settings. The signals related to various settings include, for example, a signal for a set temperature and a signal for a set humidity. The indoor control units 29*a* and 29*b* exchange control signals, measurement signals, signals related to various settings, and the like with the outdoor control unit 39*a* of the outdoor unit 30*a*, the ventilation control unit 49 of the ventilator 40, and the control unit 13 of the air conditioning control apparatus 10 via the communication line 80.

The indoor control units 29*a* and 29*b*, the outdoor control unit 39*a*, and the ventilation control unit 49 cooperate to function as a controller CL. The function of the controller C1 will be described later.

(2-2) Outdoor Unit

The outdoor unit 30*a* is a unit installed on a rooftop or the like of a building in which the refrigerant system RS1 is installed. As shown in FIG. 2, the outdoor unit 30*a* mainly includes a compressor 31*a*, a flow direction switching mechanism 32*a*, an outdoor heat exchanger 33*a*, an outdoor expansion valve 34*a*, an accumulator 35*a*, an outdoor fan 36*a*, a liquid-side shutoff valve 37*a*, a gas-side shutoff valve 38*a*, an outdoor control unit 39*a*, a suction pressure sensor 65*a*, a discharge pressure sensor 66*a*, a heat exchange temperature sensor 67*a*, and an outdoor temperature sensor 68*a*. The outdoor unit 30*a* also includes a suction pipe 54*a*, a discharge pipe 54*b*, a first gas refrigerant pipe 54*c*, a liquid refrigerant pipe 54*d*, and a second gas refrigerant pipe 54*e*.

The suction pipe 54*a* connects the flow direction switching mechanism 32*a* and a suction side of the compressor 31*a*. The suction pipe 54*a* is provided with the accumulator 35*a*. The discharge pipe 54*b* connects a discharge side of the compressor 31*a* and the flow direction switching mechanism 32*a*. The first gas refrigerant pipe 54*c* connects the flow direction switching mechanism 32*a* and a gas-side end of the outdoor heat exchanger 33*a*. The liquid refrigerant pipe 54*d* connects a liquid side of the outdoor heat exchanger 33*a* and the liquid refrigerant connection pipe 51. The liquid refrigerant pipe 54*d* is provided with the outdoor expansion valve 34*a*. The liquid-side shutoff valve 37*a* is provided at a connection portion between the liquid refrigerant pipe 54*d* and the liquid refrigerant connection pipe 51. The second gas refrigerant pipe 54*e* connects the flow direction switching mechanism 32*a* and the gas refrigerant connection pipe 52. The gas-side shutoff valve 38*a* is provided at a connection portion between the second gas refrigerant pipe 54*e* and the gas refrigerant connection pipe 52.

(2-2-1) Compressor

As shown in FIG. 2, the compressor 31*a* is a device that sucks a low-pressure refrigerant in a refrigeration cycle from the suction pipe 54*a*, compresses the refrigerant by a compression mechanism (not shown), and discharges the compressed refrigerant to the discharge pipe 54*b*.

The type of the compressor 31*a* may be of any type. For example, the compressor 31*a* is a rotary type or scroll type capacity compressor. The compressor 31*a* includes a compression mechanism (not shown) driven by a compressor motor 31*am*. The compressor motor 31*am* has the number of rotations controllable by an inverter.

(2-2-2) Flow Direction Switching Mechanism

The flow direction switching mechanism 32*a* is a mechanism that changes a state of the outdoor heat exchanger 33*a* between a first state of functioning as an evaporator and a second state of functioning as a condenser by switching a flow direction of the refrigerant. When the flow direction switching mechanism 32*a* sets the state of the outdoor heat exchanger 33*a* to the first state, the indoor heat exchangers 21*a* and 21*b* function as a condenser. On the other hand, when the flow direction switching mechanism 32*a* sets the state of the outdoor heat exchanger 33*a* to the second state, the indoor heat exchangers 21*a* and 21*b* function as an evaporator.

As shown in FIG. 2, the flow direction switching mechanism 32*a* is configured to switch the flow direction of the refrigerant discharged from the compressor 31*a* between a first flow direction A and a second flow direction B. When the flow direction switching mechanism 32*a* switches the flow direction of the refrigerant to the first flow direction A, the state of the outdoor heat exchanger 33*a* becomes the first state. When the flow direction switching mechanism 32*a* switches the flow direction of the refrigerant to the second flow direction B, the state of the outdoor heat exchanger 33*a* becomes the second state.

In the present embodiment, the flow direction switching mechanism 32*a* is a four-way switching valve.

During the heating operation, the flow direction of the refrigerant discharged from the compressor 31*a* is switched to the first flow direction A by the flow direction switching mechanism 32*a*. When the flow direction of the refrigerant is set to the first flow direction A, the flow direction switching mechanism 32*a* causes the suction pipe 54*a* to communicate with the first gas refrigerant pipe 54*c* and causes the discharge pipe 54*b* to communicate with the second gas refrigerant pipe 54*e* as indicated by a broken line in the flow direction switching mechanism 32*a* in FIG. 2. When the refrigerant flows in the first flow direction A, the refrigerant discharged from the compressor 31*a* flows through the refrigerant circuit 50 in the order of the indoor heat exchangers 21*a* and 21*b*, the indoor expansion valves 23*a* and 23*b*, the outdoor expansion valve 34*a*, and the outdoor heat exchanger 33*a*, and returns to the compressor 31*a*.

During the cooling operation, the flow direction of the refrigerant discharged from the compressor 31*a* is switched to the second flow direction B by the flow direction switching mechanism 32*a*. When the flow direction of the refrigerant is set to the second flow direction B, the flow direction switching mechanism 32*a* causes the suction pipe 54*a* to communicate with the second gas refrigerant pipe 54*e* and causes the discharge pipe 54*b* to communicate with the first gas refrigerant pipe 54*c* as indicated by a solid line in the flow direction switching mechanism 32*a* in FIG. 2. When the refrigerant flows in the second flow direction B, the refrigerant discharged from the compressor 31*a* flows through the refrigerant circuit 50 in the order of the outdoor heat exchanger 33*a*, the outdoor expansion valve 34*a*, the indoor expansion valves 23*a* and 23*b*, and the indoor heat exchangers 21*a* and 21*b*, and returns to the compressor 31*a*.

(2-2-3) Outdoor Heat Exchanger

In the outdoor heat exchanger 33*a*, heat is exchanged between the refrigerant flowing through the outdoor heat exchanger 33*a* and the outdoor air OA. The outdoor heat exchanger 33*a* may have any structure. For example, the outdoor heat exchanger 33*a* is a cross-fin type fin-and-tube heat exchanger including a heat transfer tube (not shown) and a plurality of fines (not shown).

The outdoor heat exchanger 33*a* functions as an evaporator during the heating operation and as a condenser during the cooling operation.

(2-2-4) Outdoor Expansion Valve

The outdoor expansion valve 34*a* is mechanisms for adjusting pressure and flow rate of the refrigerant flowing through the liquid refrigerant pipe 54*d*. As shown in FIG. 2, the outdoor expansion valve 34*a* is provided in the liquid refrigerant pipe 54*d*. In the present embodiment, the outdoor expansion valve 34*a* is an electronic expansion valve whose opening degree is adjustable.

(2-2-5) Accumulator

The accumulator 35*a* has a gas liquid separating function of separating refrigerant flowing into the accumulator 35*a* into a gas refrigerant and a liquid refrigerant. As shown in FIG. 2, the accumulator 35*a* is provided in the suction pipe 54*a*. The refrigerant flowing into the accumulator 35*a* is separated into a gas refrigerant and a liquid refrigerant, and the gas refrigerant collecting in an upper space flows into the compressor 31*a*.

(2-2-6) Outdoor Fan

The outdoor fan 36*a* is a fan that sucks outdoor air OA into the outdoor unit 30*a*, supplies the outdoor air OA to the outdoor heat exchanger 33*a*, and discharges the outdoor air OA subjected to heat exchange with the refrigerant in the outdoor heat exchanger 33*a* to the outside of the outdoor unit 30*a*.

The outdoor fan 36*a* is, for example, an axial fan such as a propeller fan. The outdoor fan 36*a* is driven by an outdoor fan motor 36*am*. The outdoor fan motor 36*am* has the number of rotations controllable by an inverter.

(2-2-7) Liquid-Side Shutoff Valve and Gas-Side Shutoff Valve

As shown in FIG. 2, the liquid-side shutoff valve 37*a* is a valve provided at a connection portion between the liquid refrigerant pipe 54*d* and the liquid refrigerant connection pipe 51. The gas-side shutoff valve 38*a* is a valve provided at a connection portion between the second gas refrigerant pipe 54*e* and the gas refrigerant connection pipe 52. The liquid-side shutoff valve 37*a* and the gas-side shutoff valve 38*a* are, for example, manually operated valves.

(2-2-8) Sensors

The suction pressure sensor 65*a* is a sensor that measures a suction pressure. The suction pressure sensor 65*a* is provided in the suction pipe 54*a*. The suction pressure is a low pressure value of the refrigeration cycle.

The discharge pressure sensor 66*a* is a sensor that measures a discharge pressure. The discharge pressure sensor 66*a* is provided in the discharge pipe 54*b*. The discharge pressure is a high pressure value of the refrigeration cycle.

The heat exchanger temperature sensor 67*a* measures a temperature of the refrigerant flowing in the outdoor heat exchanger 33*a*. The heat exchange temperature sensor 67*a* is provided in the outdoor heat exchanger 33*a*. The heat exchange temperature sensor 67*a* measures a refrigerant temperature corresponding to a condensation temperature during the cooling operation, and measures a refrigerant temperature corresponding to an evaporation temperature during the heating operation.

The outdoor temperature sensor 68*a* measures a temperature of the outdoor air OA in the target space SP. The outdoor temperature sensor 68*a* is provided near a suction port of the outdoor air OA of the outdoor unit 30*a*.

(2-2-9) Outdoor Control Unit

The outdoor control unit 39*a* controls the operation of each component constituting the outdoor unit 30*a*.

The outdoor control unit 39*a* is electrically connected to various devices of the outdoor unit 30*a*, which include the compressor motor 31*am*, the flow direction switching mechanism 32*a*, the outdoor expansion valve 34*a*, and the outdoor fan motor 36*am*. The outdoor control unit 39*a* is communicably connected to various sensors provided in the outdoor unit 30*a*, which include the suction pressure sensor 65*a*, the discharge pressure sensor 66*a*, the heat exchange temperature sensor 67*a*, and the outdoor temperature sensor 68*a*.

The outdoor control unit 39*a* includes a control calculator and a storage device. The control calculator is a processor such as a CPU or a GPU. The storage device is a storage medium such as a RAM, a ROM, or a flash memory. The control calculator reads a program from the storage device and executes predetermined calculation processing in accordance with the program to control the operation of each component constituting the outdoor unit 30*a*. In addition, the control calculator is capable of writing a result of calculation to the storage device and reading information from the storage device in accordance with the program. The outdoor control unit 39*a* also includes a timer.

The outdoor control unit 39*a* exchanges control signals, measurement signals, signals related to various settings, and the like with the indoor control units 29*a* and 29*b* of the indoor units 20*a* and 20*b*, the ventilation control unit 49 of the ventilator 40, and the control unit 13 of the air conditioning control apparatus 10 via the communication line 80.

The outdoor control unit 39*a*, the indoor control units 29*a* and 29*b*, and the ventilation control unit 49 cooperate to function as the controller C1. The function of the controller C1 will be described later.

(2-3) Ventilator

The ventilator 40 ventilates the target space SP in conjunction with the indoor unit 20*a*. In other words, the indoor unit 20*a* can perform the ventilation operation in conjunction with the ventilator 40. In the present embodiment, the ventilator 40 is provided in an attic 90 of the target space SP.

Figure 3:
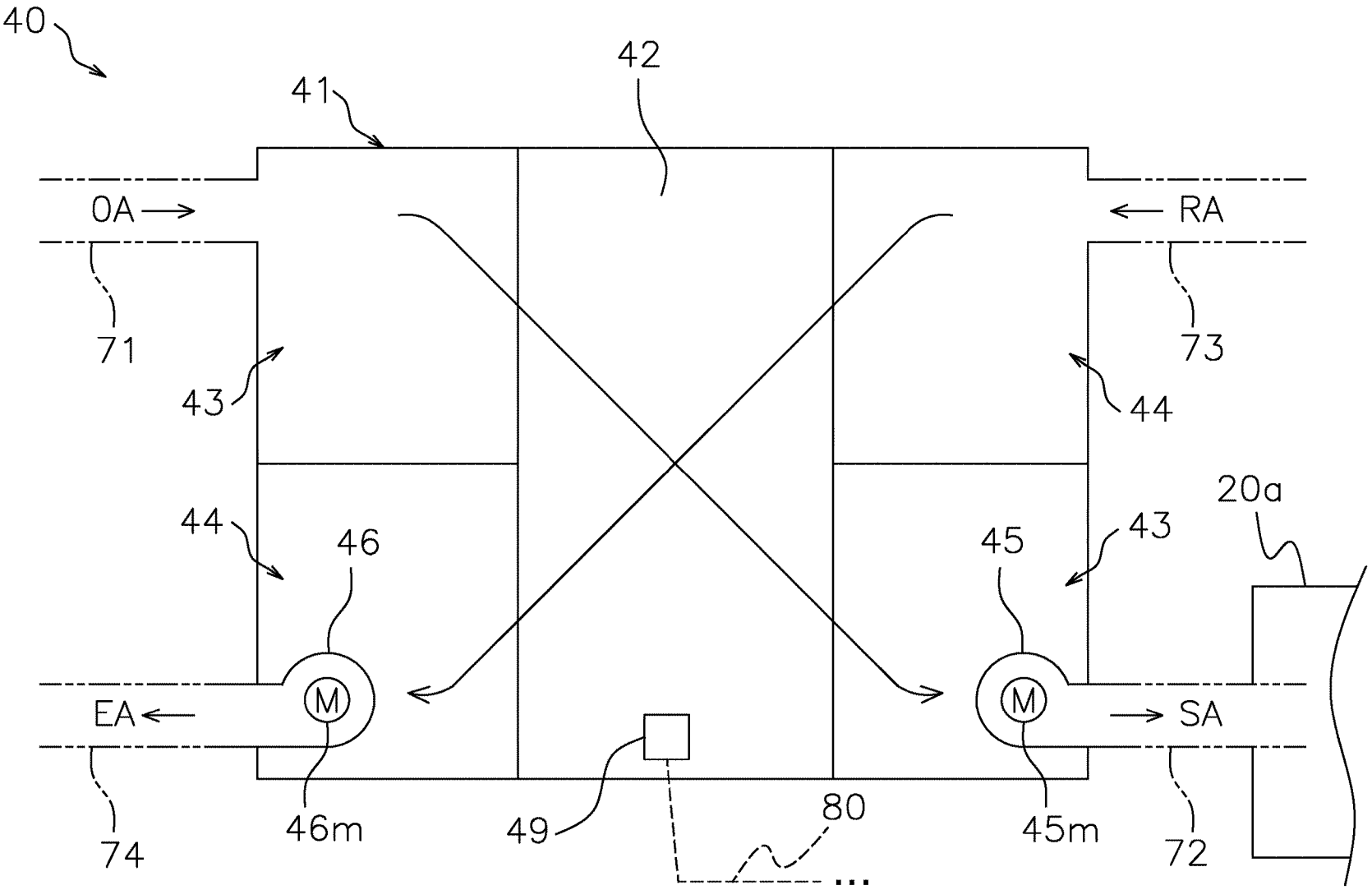
FIG. 3 is a schematic configuration diagram of a ventilator.
Figure 4:
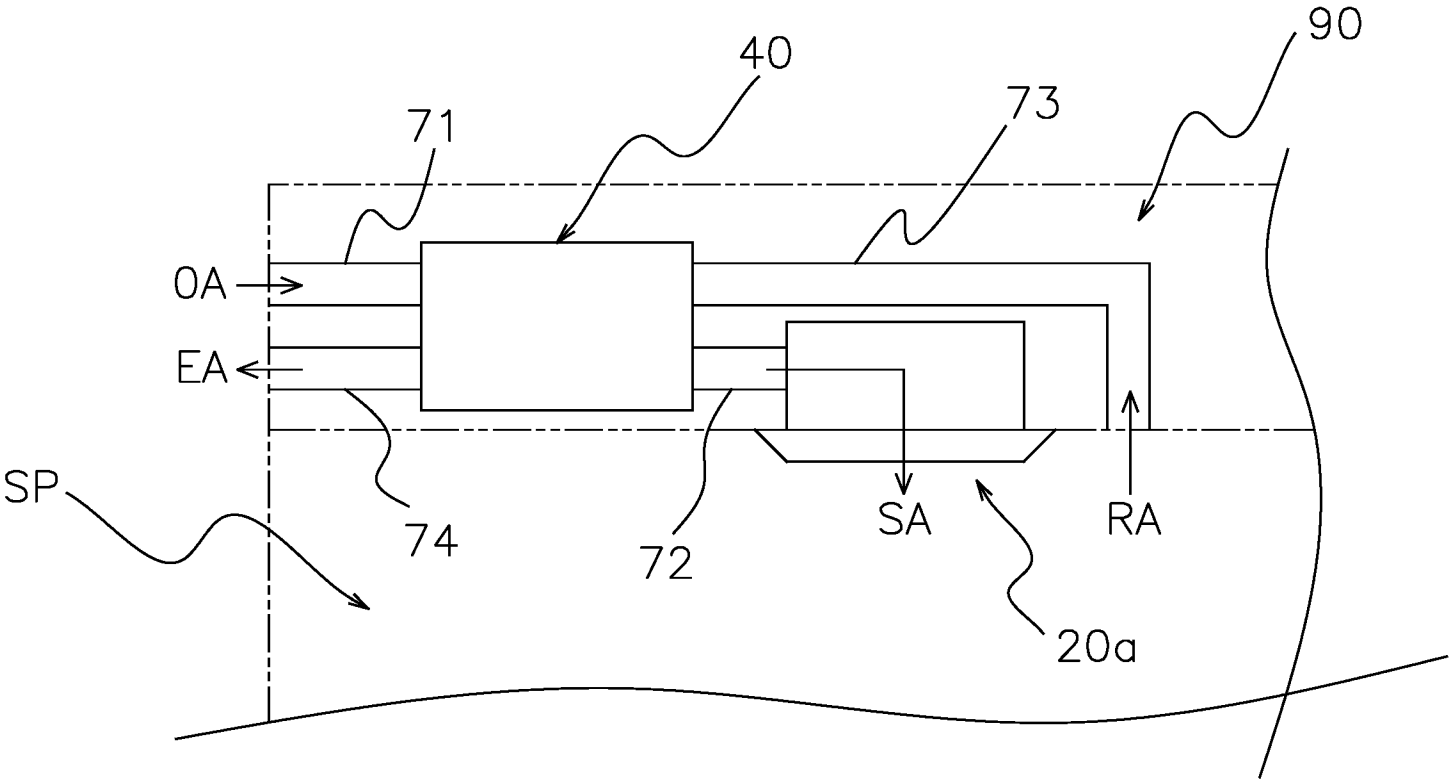
FIG. 4 is a diagram illustrating an arrangement of an indoor unit and the ventilator.

FIG. 3 is a schematic configuration diagram of the ventilator 40. FIG. 4 is a diagram illustrating an arrangement of the indoor unit 20*a* and the ventilator 40. As shown in FIG. 3, the ventilator 40 mainly includes an inlet duct 71, the air supply duct 72, an outlet duct 73, an exhaust duct 74, a device body 41, and the ventilation control unit 49.

The inlet duct 71 is connected to an inlet for taking the outdoor air OA into the target space SP. As shown in FIG. 4, the air supply duct 72 is connected to the indoor unit 20*a* that also serves as an air supply port for supplying the outdoor air OA to the target space SP as a supply air SA. The outlet duct 73 is connected to an outlet for taking out the indoor air RA from the target space SP. The exhaust duct 74 is connected to a discharge port for discharging the indoor air RA to the outside as a discharge air EA. The device body 41 is connected to the inlet duct 71, the air supply duct 72, the outlet duct 73, and the exhaust duct 74.

The device body 41 is provided with a ventilation heat exchanger 42, and two ventilation passages 43 and 44 partitioned from each other are formed so as to cross the ventilation heat exchanger 42. Here, the ventilation heat exchanger 42 is a total heat exchanger that simultaneously exchanges sensible heat and latent heat between two air flows (here, the indoor air RA and the outdoor air OA), and is provided across the ventilation passages 43 and 44. One ventilation passage 43 has one end connected to the inlet duct 71 and the other end connected to the air supply duct 72, and constitutes an air supply path for flowing air from the outside toward the target space SP via the indoor unit 20*a*. The other ventilation path 44 has one end connected to the outlet duct 73 and the other end connected to the exhaust duct 74, and constitutes an exhaust path for flowing air from the target space SP to the outside. The ventilation passage 43 is provided with an air supply fan 45 driven by an air supply fan motor 45*m* in order to generate an air flow from the outside toward the target space SP via the indoor unit 20*a*, and the ventilation passage 44 is provided with an exhaust fan 46 driven by an exhaust fan motor 46*m* in order to generate an air flow from the target space SP toward the outside. The air supply fan 45 and the exhaust fan 46 are disposed downstream of the ventilation heat exchanger 42 in the air flow.

The ventilation control unit 49 controls the operation of each unit constituting the ventilator 40.

The ventilation control unit 49 is electrically connected to various devices of the ventilator 40, which include the air supply fan motor 45*m* and the exhaust fan motor 46*m*.

The ventilation control unit 49 includes a control calculator and a storage device. The control calculator is a processor such as a CPU or a GPU. The storage device is a storage medium such as a RAM, a ROM, or a flash memory. The control calculator reads a program from the storage device and executes predetermined calculation processing in accordance with the program to control the operation of each component constituting the ventilator 40. In addition, the control calculator is capable of writing a result of calculation to the storage device and reading information from the storage device in accordance with the program. The ventilation control unit 49 also includes a timer.

The ventilation control unit 49 exchanges control signals, measurement signals, signals related to various settings, and the like with the indoor control units 29*a* and 29*b* of the indoor units 20*a* and 20*b*, the outdoor control unit 39*a* of the outdoor unit 30*a*, and the control unit 13 of the air conditioning control apparatus 10 via the communication line 80.

The ventilation control unit 49 the indoor control units 29*a* and 29*b*, and the outdoor control unit 39*a* cooperate to function as the controller C1. The function of the controller C1 will be described later.

(2-4) Controllers

In the present embodiment, the cooperation of the indoor control units 29*a* and 29*b* of the indoor units 20*a* and 20*b*, the outdoor control unit 39*a* of the outdoor unit 30*a*, and the ventilation control unit 49 of the ventilator 40 functions as the controller C1 that controls the operation of the refrigerant system RS1.

Figure 5A:
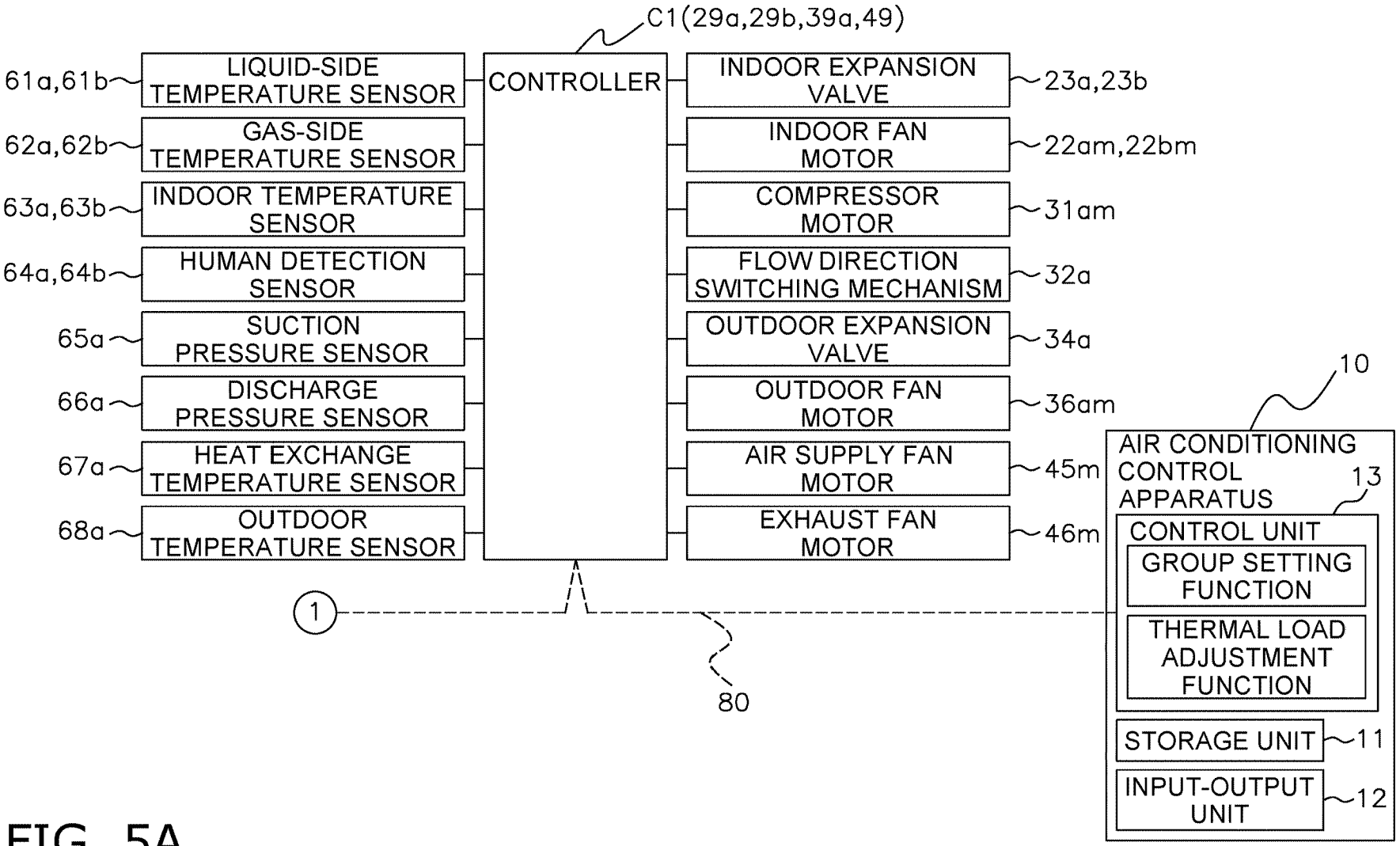
FIG. 5A is a control block diagram of the air conditioning system.
Figure 5B:
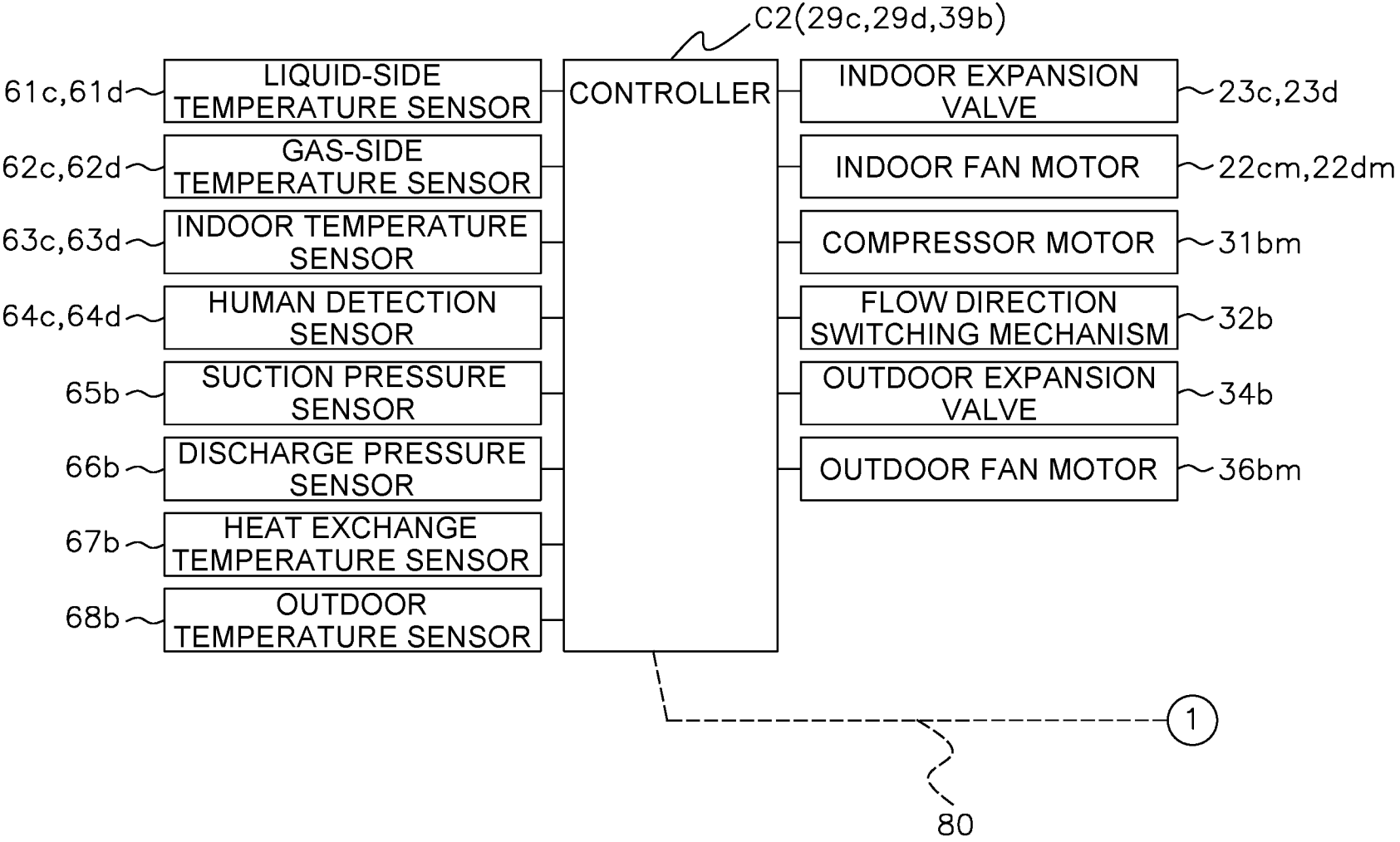
FIG. 5B is a control block diagram of the air conditioning system.

FIGS. 5A and 5B are control block diagrams of the air conditioning system 1. As illustrated in FIG. 5A, the controller C1 is communicably connected to the liquid-side temperature sensors 61*a* and 61*b*, the gas-side temperature sensors 62*a* and 62*b*, the indoor temperature sensors 63*a* and 63*b*, the human detection sensors 64*a* and 64*b*, the suction pressure sensor 65*a*, the discharge pressure sensor 66*a*, the heat exchange temperature sensor 67*a*, and the outdoor temperature sensor 68*a*. The controller C1 receives measurement signals transmitted from various sensors. The controller C1 is electrically connected to the indoor expansion valves 23*a* and 23*b*, the indoor fan motors 22*am* and 22*bm*, the compressor motor 31*am*, the flow direction switching mechanism 32*a*, the outdoor expansion valve 34*a*, the outdoor fan motor 36*am*, the air supply fan motor 45*m*, and the exhaust fan motor 46*m*. The controller C1 controls the operation of the devices of the refrigerant system RS1, which include the indoor expansion valves 23*a* and 23*b*, the indoor fan motors 22*am* and 22*bm*, the compressor motor 31*am*, the flow direction switching mechanism 32*a*, the outdoor expansion valve 34*a*, the outdoor fan motor 36*am*, the air supply fan motor 45*m*, and the exhaust fan motor 46*m*, on the basis of the measurement signals of the various sensors in accordance with the control signal transmitted from the operation remote controller of the refrigerant system RS1 and the control signal transmitted from the air conditioning control apparatus 10.

Similarly, the cooperation between the indoor control units 29*c* and 29*d* of the indoor units 20*c* and 20*d* and the outdoor control unit 39*b* of the outdoor unit 30*b* functions as a controller C2 that controls the operation of the refrigerant system RS2. As shown in FIG. 5B, the controller C2 is communicably connected to liquid-side temperature sensors 61*c* and 61*d*, gas-side temperature sensors 62*c* and 62*d*, indoor temperature sensors 63*c* and 63*d*, human detection sensors 64*c* and 64*d*, a suction pressure sensor 65*b*, a discharge pressure sensor 66*b*, a heat exchange temperature sensor 67*b*, and an outdoor temperature sensor 68*b*. The controller C2 receives measurement signals transmitted from various sensors. The controller C2 is electrically connected to indoor expansion valves 23*c* and 23*d*, indoor fan motors 22*cm* and 22*dm*, a compressor motor 31*bm*, a flow direction switching mechanism 32*b*, an outdoor expansion valve 34*b*, and an outdoor fan motor 36*bm*. The controller C2 controls the operation of the devices of the refrigerant system RS2, which include the indoor expansion valves 23*c* and 23*d*, the indoor fan motors 22*cm* and 22*dm*, the compressor motor 31*bm*, the flow direction switching mechanism 32*b*, the outdoor expansion valve 34*b*, and the outdoor fan motor 36*bm*, on the basis of the measurement signals of the various sensors in accordance with the control signal transmitted from the operation remote controller of the refrigerant system RS2 and the control signal transmitted from the air conditioning control apparatus 10.

The controller C1 controls various devices of the refrigerant system RS1 to cause the indoor units 20*a* and 20*b* to perform the cooling operation, the heating operation, the fan operation, and the ventilation operation. The cooling operation, the heating operation, the fan operation, and the ventilation operation that the controller C1 causes the indoor unit 20*a* to perform will be described below.

(2-4-1) Cooling Operation

When receiving an instruction to cause the indoor unit 20*a* to perform the cooling operation from the operation remote controller or the air conditioning control apparatus 10, the controller C1 controls the flow direction switching mechanism 32*a* to a state indicated by the solid line in FIG. 2 to set the state of the outdoor heat exchanger 33*a* to the second state of functioning as a condenser. Then, the controller C1 fully opens the outdoor expansion valve 34*a*, and adjusts the opening degree of the indoor expansion valve 23*a* to set a degree of superheating of the refrigerant at a gas-side outlet of the indoor heat exchanger 21*a* to a predetermined target degree of superheating. The degree of superheating of the refrigerant at the gas-side outlet of the indoor heat exchanger 21*a* is calculated, for example, by subtracting an evaporation temperature converted from a measurement value (suction pressure) of the suction pressure sensor 65*a* from a measurement value of the gas-side temperature sensor 62*a*.

The controller C1 controls an operating capacity of the compressor 31*a* to cause the evaporation temperature converted from the measurement value (suction pressure) of the suction pressure sensor 65*a* to approach a predetermined target evaporation temperature. The operating capacity of the compressor 31*a* is controlled by controlling the number of rotations of the compressor motor 31*am*.

When the operation of the devices is controlled as described above, the refrigerant flows through the refrigerant circuit 50 during the cooling operation as follows.

When the compressor 31*a* is started, a low-pressure gas refrigerant in the refrigeration cycle is sucked into the compressor 31*a* and compressed by the compressor 31*a* to become a high-pressure gas refrigerant in the refrigeration cycle. The high-pressure gas refrigerant is sent to the outdoor heat exchanger 33*a* via the flow direction switching mechanism 32*a*, exchanges heat with heat source air supplied by the outdoor fan 36*a*, and is condensed into a high-pressure liquid refrigerant. The high-pressure liquid refrigerant flows through the liquid refrigerant pipe 54*d* and passes through the outdoor expansion valve 34*a*. The high-pressure liquid refrigerant sent to the indoor unit 20*a* is decompressed to near the suction pressure of the compressor 31*a* in the indoor expansion valve 23*a*, becomes a refrigerant in a gas-liquid two-phase state, and is sent to the indoor heat exchanger 21*a*. The refrigerant in the gas-liquid two-phase state exchanges heat with the air in the target space SP supplied to the indoor heat exchanger 21*a* by the indoor fan 22*a* in the indoor heat exchanger 21*a* and evaporates to become a low-pressure gas refrigerant. The low-pressure gas refrigerant is sent to the outdoor unit 30*a* via the gas refrigerant connection pipe 52, and flows into the accumulator 35*a* via the flow direction switching mechanism 32*a*. The low-pressure gas refrigerant flowing into the accumulator 35*a* is again sucked into the compressor 31*a*. On the other hand, the temperature of the air supplied to the indoor heat exchanger 21*a* decreases by heat exchange with the refrigerant flowing through the indoor heat exchanger 21*a*, and the air cooled by the indoor heat exchanger 21*a* is blown into the target space SR.

(2-4-2) Heating Operation

When receiving an instruction to cause the indoor unit 20*a* to perform the heating operation from the operation remote controller or the air conditioning control apparatus 10, the controller C1 controls the flow direction switching mechanism 32*a* to a state indicated by the broken line in FIG. 2 to set the state of the outdoor heat exchanger 33*a* to the first state of functioning as an evaporator. Then, the controller C1 adjusts the opening degree of the indoor expansion valve 23*a* to set a degree of subcooling of the refrigerant at a liquid-side outlet of the indoor heat exchanger 21*a* to a predetermined target degree of subcooling. The degree of subcooling of the refrigerant at the liquid-side outlet of the indoor heat exchanger 21*a* is calculated, for example, by subtracting a measurement value of the liquid-side temperature sensor 61*a* from a condensation temperature converted from a measurement value (discharge pressure) of the discharge pressure sensor 66*a*.

The controller C1 also adjusts the opening degree of the outdoor expansion valve 34*a* to decompress the refrigerant flowing into the outdoor heat exchanger 33*a* to a pressure at which the refrigerant can evaporate in the outdoor heat exchanger 33*a*.

The controller C1 controls an operating capacity of the compressor 31*a* to cause the condensation temperature converted from the measurement value (discharge pressure) of the discharge pressure sensor 66*a* to approach a predetermined target condensation temperature. The operating capacity of the compressor 31*a* is controlled by controlling the number of rotations of the compressor motor 31*am*.

When the operation of the devices is controlled as described above, the refrigerant flows through the refrigerant circuit 50 during the heating operation as follows.

When the compressor 31*a* is started, a low-pressure gas refrigerant in the refrigeration cycle is sucked into the compressor 31*a* and compressed by the compressor 31*a* to become a high-pressure gas refrigerant in the refrigeration cycle. The high-pressure gas refrigerant is sent to the indoor heat exchanger 21*a* via the flow direction switching mechanism 32*a*, exchanges heat with the air in the target space SP supplied by the indoor fan 22*a*, and is condensed into a high-pressure liquid refrigerant. The temperature of the air supplied to the indoor heat exchanger 21*a* rises by heat exchange with the refrigerant flowing through the indoor heat exchanger 21*a*, and the air heated by the indoor heat exchanger 21*a* is blown into the target space SP. The high-pressure liquid refrigerant having passed through the indoor heat exchanger 21*a* passes through the indoor expansion valve 23*a* to be decompressed. The refrigerant decompressed in the indoor expansion valve 23*a* is sent to the outdoor unit 30*a* via the liquid refrigerant connection pipe 51, and flows into the liquid refrigerant pipe 54*d*. The refrigerant flowing through the liquid refrigerant pipe 54*d* is decompressed to near the suction pressure of the compressor 31*a* when passing through the outdoor expansion valve 34*a*, becomes the refrigerant in the gas-liquid two-phase state, and flows into the outdoor heat exchanger 33*a*. The low-pressure refrigerant in the gas-liquid two-phase state that has flowed into the outdoor heat exchanger 33*a* exchanges heat with the heat source air supplied by the outdoor fan 36*a*, evaporates to become a low-pressure gas refrigerant, and flows into the accumulator 35*a* via the flow direction switching mechanism 32*a*. The low-pressure gas refrigerant flowing into the accumulator 35*a* is again sucked into the compressor 31*a*.

(2-4-3) Fan Operation

When receiving an instruction to cause the indoor unit 20*a* to perform the fan operation from the operation remote controller or the air conditioning control apparatus 10, the controller C1 fully closes the indoor expansion valve 23*a*. Then, the controller C1 controls the indoor fan motor 22*am* so as to have a predetermined target air volume, sucks the indoor air RA of the target space SP into the indoor unit 20*a*, and supplies the sucked indoor air RA to the target space SP again. As a result, the indoor air RA in the target space SP is stirred or circulated.

(2-4-4) Ventilation Operation

When receiving an instruction to cause the indoor unit 20*a* to perform the ventilation operation from the operation remote controller or the air conditioning control apparatus 10, the controller C1 causes the indoor unit 20 *a* to perform the fan operation with a low air volume and activates the air supply fan 45 and the exhaust fan 46 of the ventilator 40. Then, the outdoor air OA flowing into the device body 41 from the outside through the inlet duct 71 and the indoor air RA flowing into the device body 41 from the target space SP through the outlet duct 73 exchange heat in the ventilation heat exchanger 42. Next, the outdoor air OA having exchanged heat in the ventilation heat exchanger 42 is supplied as the supply air SA from the device body 41 to the target space SP via the indoor unit 20*a* through the air supply duct 72. The indoor air RA having exchanged heat in the ventilation heat exchanger 42 is discharged as the discharge air EA from the device body 41 to the outside through the exhaust duct 74.

(2-5) Air Conditioning Control Apparatus

The air conditioning control apparatus 10 controls the indoor units 20*a* to 20*d*, the outdoor units 30*a* and 30*b*, and the ventilator 40 to execute various operations and various functions. As shown in FIG. 5A, the air conditioning control apparatus 10 mainly includes a storage unit 11, an input-output unit 12, and the control unit 13.

(2-5-1) Storage Unit

The storage unit 11 is a storage device such as a RAM, a ROM, or a hard disk drive (HDD). The storage unit 11 stores a program executed by the control unit 13, data necessary for executing the program, and the like.

(2-5-2) Input-Output Unit

The input-output unit 12 is a touch panel display for inputting and outputting information to and from the air conditioning control apparatus 10. A user can input various types of information and execute various operations and various functions by tapping, sliding, and the like on the display with a finger, for example. In addition, the input-output unit 12 can display operation statuses and the like of the indoor units 20*a* to 20*d*, the outdoor units 30*a* and 30*b*, and the ventilator 40.

(2-5-3) Control Unit

The control unit 13 is a calculation processor such as a CPU. As shown in FIG. 5A, the control unit 13 reads and executes a program stored in the storage unit 11 to implement various functions of the air conditioning control apparatus 10. The control unit 13 can also write a calculation result to the storage unit 11 and read information stored in the storage unit 11 in accordance with the program.

As shown in FIGS. 5A and 5B, the control unit 13 exchanges control signals, measurement signals, signals related to various settings, and the like with the indoor control units 29*a* to 29*d* of the indoor units 20*a* to 20*d*, the outdoor control units 39*a* and 39*b* of the outdoor units 30*a* and 30*b*, and the ventilation control unit 49 of the ventilator 40 via the communication line 80. Then, the control unit 13 controls the indoor units 20*a* to 20*d*, the outdoor units 30*a* and 30*b*, and the ventilator 40 in cooperation with the controllers C1 and C2. In particular, the control unit 13 can cause the indoor units 20*a* to 20*d* to perform the cooling operation, the heating operation, the fan operation, or the ventilation operation.

As shown in FIG. 5A, the control unit 13 has a grouping function and a thermal load adjustment function as main functions.

(2-5-3-1) Group Setting Function

A group setting function is a function of setting a group GP of the indoor units to be subjected to the thermal load adjustment function. The control unit 13 sets the indoor unit designated by using the input-output unit 12 among the indoor units 20*a* to 20*d* as one group GP (indoor unit group). For example, the control unit 13 may set all the indoor units 20*a* to 20*d* as one group GP. The control unit 13 may also set, for example, some of the indoor units 20*a* to 20*d* such as the indoor unit 20*a* and the indoor unit 20*b* as one group GP. The control unit 13 may also set, as one group GP, indoor units belonging to different refrigerant systems, such as the indoor unit 20*a* and the indoor unit 20*c*, for example.

As shown in FIG. 1, the present embodiment will be described on the assumption that the indoor units 20*a* to 20*c* are set as one group GP1.

(2-5-3-2) Thermal Load Adjustment Function

The thermal load adjustment function is a function of eliminating a difference between thermal loads when a difference of a certain level or more occurs in thermal loads to be processed by each of the indoor units 20*a* to 20*c* belonging to the group GP1.

Figure 6:
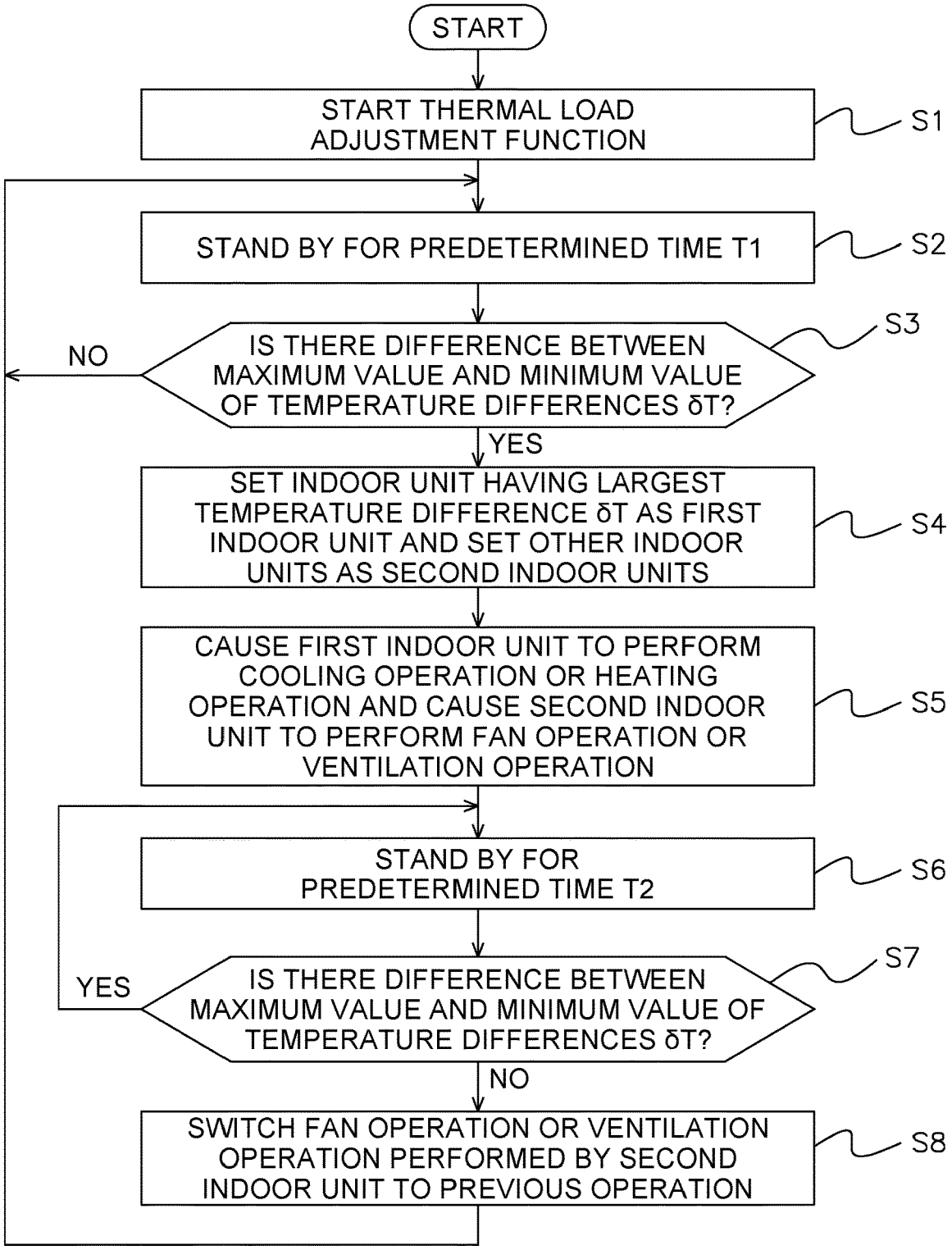
FIG. 6 is a flowchart for describing processing of a thermal load adjustment function.

Hereinafter, the processing of the thermal load adjustment function will be described with reference to a flowchart of FIG. 6. As an assumption, the indoor units 20*a* to 20*c* are performing the cooling operation or the heating operation.

As shown in step S1, the control unit 13 starts the thermal load adjustment function by an instruction from the input-output unit 12 or the like.

When step S1 ends and the processing proceeds to step S2, the control unit 13 stands by for a predetermined time T1.

When step S2 ends and the processing proceeds to step S3, the control unit 13 determines whether a difference of a certain level or more occurs in thermal loads to be processed by each of the indoor units 20*a* to 20*c*. In the present embodiment, the thermal load to be processed by each of the indoor units 20*a* to 20*c* is determined on the basis of a temperature difference δT between a set temperature and a room temperature of each of the indoor units 20*a* to 20*c*. Specifically, it is regarded that the larger the temperature difference ST, the larger the thermal load. The room temperature can be acquired from measurement values of the indoor temperature sensors 63*a* to 63*c* of the indoor units 20*a* to 20*c*. Therefore, in step S3, the control unit 13 determines whether there is a difference of a certain level or more between a maximum value and a minimum value of the temperature differences δT of the indoor units 20*a* to 20*c*. Here, the "difference of a certain level or more" is, for example, 5° C. For example, when the temperature differences δT of the indoor units 20*a* to 20*c* are 2° C., 1° C., and 6° C., respectively, since there is a difference of 5° C. or more between the temperature difference δT (minimum value) of the indoor unit 20*b* and the temperature difference δT (maximum value) of the indoor unit 20*c*, the control unit 13 determines that a difference of a certain level or more occurs in thermal loads to be processed by each of the indoor units 20*a* to 20*c*. In step S3, when there is a difference of a certain level or more between the maximum value and the minimum value of the temperature differences δT, the processing proceeds to step S4. In step S3, when there is not a difference of a certain level or more between the maximum value and the minimum value of the temperature differences δT, the processing returns to step S2, and the control unit 13 stands by for the predetermined time T1 again. In other words, the control unit 13 determines whether there is a difference of a certain level or more between the maximum value and the minimum value of the temperature differences δT of the indoor units 20*a* to 20*c* every predetermined time T1.

When step S3 ends and the processing proceeds to step S4, the control unit 13 divides the indoor units 20*a* to 20*c* into a first indoor unit and a second indoor unit. In the present embodiment, the control unit 13 divides the indoor units 20*a* to 20*c* into the first indoor unit and the second indoor unit so that the second indoor unit has a smaller thermal load to be processed than the first indoor unit. In the present embodiment, the control unit 13 sets the indoor unit having the largest thermal load to be processed as the first indoor unit, and sets the other indoor units as the second indoor units. Therefore, in step S4, the control unit 13 sets the indoor unit having the largest temperature difference δT among the indoor units 20*a* to 20*c* as the first indoor unit, and sets the other indoor units as the second indoor units. In the above example, the indoor unit 20*c* is the first indoor unit, and the indoor units 20*a* and 20*b* are the second indoor units.

When step S4 ends and the processing proceeds to step S5, the control unit 13 causes the first indoor unit to perform the cooling operation or the heating operation. Since the first indoor unit has a relatively large thermal load to be processed, the control unit 13 causes the first indoor unit to perform the cooling operation or the heating operation to actively process the thermal load. In the present embodiment, the control unit 13 causes the first indoor unit currently performing the cooling operation to continuously perform the cooling operation. The control unit 13 causes the first indoor unit currently performing the heating operation to continuously perform the heating operation. In the above example, the control unit 13 causes the indoor unit 20*c* to continuously perform the cooling operation or the heating operation.

In step S5, the control unit 13 causes the second indoor unit to perform the fan operation or the ventilation operation. Since the second indoor unit has a relatively small thermal load to be processed, the control unit 13 causes the second indoor unit to perform the fan operation or the ventilation operation, and stirs or circulates the indoor air RA in the target space SP to assist thermal load processing performed by the first indoor unit. In the present embodiment, when the second indoor unit cannot perform the ventilation operation, the control unit 13 causes the second indoor unit to perform the fan operation. When the second indoor unit can perform the ventilation operation, the control unit 13 causes the second indoor unit to perform the ventilation operation if the set temperature of the second indoor unit and the outdoor temperature are within a predetermined range, and causes the second indoor unit to perform the fan operation otherwise. The outdoor temperature can be acquired from a measurement value of the outdoor temperature sensor 68*a*. In the above example, since the indoor unit 20*a* can perform the ventilation operation, the control unit 13 causes the indoor unit 20*a* to perform the ventilation operation if the set temperature of the indoor unit 20*a* and the outdoor temperature are within the predetermined range, and causes the indoor unit 20*a* to perform the fan operation otherwise. Since the indoor unit 20*b* cannot perform the ventilation operation, the control unit 13 causes the indoor unit 20*b* to perform the fan operation. At this time, in order to further stir or circulate the indoor air RA in the target space SP, the control unit 13 may cause the second indoor unit to perform the fan operation or the ventilation operation with an air volume higher than an air volume during an operation before the fan operation or the ventilation operation is performed.

When step S5 ends and the processing proceeds to step S6, the control unit 13 stands by for a predetermined time T2.

When step S6 ends and the processing proceeds to step S7, the control unit 13 determines whether there is a difference of a certain level or more between the maximum value and the minimum value of the temperature differences δT of the indoor units 20*a* to 20*c*. When there is a difference of a certain level or more between the maximum value and the minimum value of the temperature differences δT, the processing returns to step S6, and the control unit 13 stands by for the predetermined time T2 again. In other words, the control unit 13 determines whether there is a difference of a certain level or more between the maximum value and the minimum value of the temperature differences δT of the indoor units 20*a* to 20*c* every predetermined time T2. When there is not a difference of a certain level or more between the maximum value and the minimum value of the temperature differences δT, the processing proceeds to step S8.

When step S7 ends and the processing proceeds to step S8, the control unit 13 switches the fan operation or the ventilation operation performed by the second indoor unit to the operation before the fan operation or the ventilation operation is performed. In the above example, the control unit 13 switches the fan operation or the ventilation operation performed by the indoor units 20*a* and 20*b* to the operation before the fan operation or the ventilation operation is performed.

When step S8 ends and the processing proceeds to step S2, the control unit 13 determines whether there is a difference of a certain level or more between the maximum value and the minimum value of the temperature differences δT of the indoor units 20*a* to 20*c* every predetermined time T1 again.

The control unit 13 repeats this processing until the thermal load adjustment function is stopped by an instruction from the input-output unit 12 or the like. When the thermal load adjustment function is stopped, the control unit 13, for example, switches the fan operation or the ventilation operation performed by the second indoor unit to the operation before the fan operation or the ventilation operation is performed.

(3) Characteristics (3-1)

There is a conventional technique for controlling a circulation amount of the refrigerant to be equal between the indoor units when there is an extreme difference in a distribution ratio of the refrigerant between the indoor units in order to adjust the circulation amount of the refrigerant and improve a non-uniform temperature distribution in the space. However, there is a problem that the non-uniform temperature distribution in the space cannot be sufficiently improved by simply adjusting the circulation amount of the refrigerant because warm air is accumulated on an upper side and cold air is accumulated on a lower side.

The air conditioning control apparatus 10 according to the present embodiment controls the plurality of indoor units 20*a* to 20*d*. The air conditioning control apparatus 10 sets the indoor units 20*a* to 20*c* having been designated among the plurality of indoor units 20*a* to 20*d* as one group GP1. The air conditioning control apparatus 10 causes the first indoor unit belonging to the group GP1 to perform the cooling operation or the heating operation and causes the second indoor unit belonging to the group GP1 to perform the fan operation or the ventilation operation when a difference of a certain level or more occurs in thermal loads to be processed by each of the indoor units 20*a* to 20*c* belonging to the group GP1.

The air conditioning control apparatus 10 according to the present embodiment causes the second indoor unit to perform the fan operation or the ventilation operation when a difference of a certain level or more occurs in thermal loads to be processed by each of the indoor units 20*a* to 20*c* belonging to the group GP1. As a result, the air conditioning control apparatus 10 can improve the non-uniform temperature distribution in the target space SP by stirring the indoor air RA in the target space SP.

(3-2)

The air conditioning control apparatus 10 according to the present embodiment causes the first indoor unit to perform the cooling operation or the heating operation and causes the second indoor unit to perform the fan operation or the ventilation operation on the basis of the temperature difference δT between the set temperature and the room temperature of each of the indoor units 20*a* to 20*c* belonging to the group GP1.

As a result, on the basis of the temperature difference δT between the set temperature and the room temperature of each of the indoor units 20*a* to 20*c*, the air conditioning control apparatus 10 can easily know the thermal load to be processed by each of the indoor units 20*a* to 20*c*, and can cause the second indoor unit to perform the fan operation or the ventilation operation.

(3-3)

In the air conditioning control apparatus 10 according to the present embodiment, the thermal load to be processed by the second indoor unit is smaller than the thermal load to be processed by the first indoor unit.

As a result, the air conditioning control apparatus 10 stirs the indoor air RA in the target space SP by using the indoor unit with a smaller thermal load to be processed while continuing the operation of the indoor unit with a larger thermal load, and thus, can improve the non-uniform temperature distribution in the target space SR.

(3-4)

The air conditioning control apparatus 10 according to the present embodiment causes the second indoor unit to perform the fan operation or the ventilation operation with the air volume higher than the air volume during an operation before the fan operation or the ventilation operation is performed.

As a result, the air conditioning control apparatus 10 can further improve the non-uniform temperature distribution in the target space SP by further stirring the indoor air RA in the target space SP.

(3-5)

The air conditioning control apparatus 10 according to the present embodiment switches the fan operation or the ventilation operation performed by the second indoor unit to the operation before the fan operation or the ventilation operation is performed, on the basis of the temperature difference δT between the set temperature and the room temperature of the second indoor unit or the thermal load to be processed by each of the indoor units 20*a* to 20*c* other than the second indoor unit and belonging to the group GP1.

As a result, after the non-uniform temperature distribution in the target space SP is improved, the air conditioning control apparatus 10 can cause the second indoor unit to return to the operation before the fan operation or the ventilation operation is performed.

(3-6)

The air conditioning system 1 according to the present embodiment includes the air conditioning control apparatus 10 and the plurality of indoor units 20*a* to 20*d*.

(4) Modifications (4-1) Modification 1A

In the present embodiment, the air conditioning system 1 includes four indoor units 20*a* to 20*d*, two outdoor units 30*a* and 30*b*, and one ventilator 40. The air conditioning system 1 has two refrigerant systems RS1 and RS2.

However, the configuration of the air conditioning system 1 is arbitrary, and for example, the air conditioning system 1 may include more devices and more refrigerant systems.

(4-2) Modification 1B

In the present embodiment, for convenience, the indoor unit 20*a* is in conjunction with the ventilator 40 in order to cause the indoor unit 20*a* to perform the ventilation operation. Alternatively, the ventilator 40 may be in conjunction with any of the indoor units 20*a* to 20*d*.

(4-3) Modification 1C

In the present embodiment, in the air conditioning control apparatus 10, the thermal load to be processed by each of the indoor units 20*a* to 20*c* belonging to the group GP1 is determined on the basis of the temperature difference δT between the set temperature and the room temperature of each of the indoor units 20*a* to 20*c*.

Alternatively, the air conditioning control apparatus 10 may determine the thermal load to be processed by each of the indoor units 20*a* to 20*c* on the basis of a target condensation temperature (in the case of the heating operation) or a target evaporation temperature (in the case of the cooling operation) requested by each of the indoor units 20*a* to 20*c* to each of the outdoor units 30*a* and 30*b* to which the indoor units 20*a* to 20*c* are respectively connected. In other words, the air conditioning control apparatus 10 causes the first indoor unit to perform the cooling operation or the heating operation and causes the second indoor unit to perform the fan operation or the ventilation operation on the basis of the target condensation temperature (in the case of the heating operation) or the target evaporation temperature (in the case of the cooling operation) requested by each of the indoor units 20*a* to 20*c* to each of the outdoor units 30*a* and 30*b* to which the indoor units 20*a* to 20*c* are respectively connected. The indoor units 20*a* to 20*c* belonging to the group GP1 form a refrigeration cycle together with the outdoor units 30*a* and 30*b*. For example, when the indoor units 20*a* to 20*c* are performing the cooling operation, the air conditioning control apparatus 10 determines the thermal load to be processed by each of the indoor units 20*a* to 20*c* on the basis of a temperature difference between the evaporation temperature converted from the current measurement values (suction pressures) of the suction pressure sensors 65*a* and 65*b* and the target evaporation temperature. In this case, it is considered that the larger the temperature difference, the larger the thermal load.

As a result, on the basis of the condensation temperature or the evaporation temperature required by each of the indoor units 20*a* to 20*c* to each of the outdoor units 30*a* and 30*b*, the air conditioning control apparatus 10 can more accurately know the thermal load to be processed by each of the indoor units 20*a* to 20*c*, and can cause the second indoor unit to perform the fan operation or the ventilation operation.

(4-4) Modification 1D

In the present embodiment, the air conditioning control apparatus 10 determines whether there is a difference of a certain level or more between the maximum value and the minimum value of the temperature differences δT of the indoor units 20*a* to 20*c* belonging to the group GP1.

However, for example, the air conditioning control apparatus 10 may determine whether there is a variance of a certain level or more between the temperature differences δT of the indoor units 20*a* to 20*c*.

(4-5) Modification 1E

In the present embodiment, the air conditioning control apparatus 10 sets the indoor unit having the largest thermal load to be processed as the first indoor unit, and sets the other indoor units as the second indoor units.

However, the air conditioning control apparatus 10 may set a predetermined number of indoor units as the first indoor unit and set the other indoor units as the second indoor unit, for example, in the order of a larger thermal load to be processed.

(4-6) Modification 1F

The air conditioning control apparatus 10 may have a function (automatic stop function) of automatically stopping the cooling operation or the heating operation of the indoor units 20*a* to 20*d* in accordance with the set temperature. Specifically, while the indoor units 20*a* to 20*d* are performing the cooling operation, the air conditioning control apparatus 10 automatically stops the cooling operation of the indoor units 20*a* to 20*d* when the room temperature falls below the set temperature and the temperature difference between the set temperature and the room temperature becomes larger than a predetermined threshold value (when an automatic stop condition is satisfied). While the indoor units 20*a* to 20*d* are performing the heating operation, the air conditioning control apparatus 10 automatically stops the heating operation of the indoor units 20*a* to 20*d* when the room temperature exceeds the set temperature and the temperature difference between the set temperature and the room temperature becomes larger than a predetermined threshold value (when an automatic stop condition is satisfied). The predetermined threshold value is, for example, 2° C. In other words, in any one of the indoor units 20*a* to 20*d*, when the automatic stop condition is satisfied, it can be said that a difference of a certain level or more occurs in thermal loads to be processed by each of the indoor units 20*a* to 20*d*. In this case, the indoor unit satisfying the automatic stop condition is an indoor unit having a small thermal load to be processed.

Therefore, the air conditioning control apparatus 10 may use the automatic stop function to set the indoor unit that satisfies the automatic stop condition as the second indoor unit. In this case, the air conditioning control apparatus 10 does not stop the operation of the indoor unit that satisfies the automatic stop condition, but causes the indoor unit that satisfies the automatic stop condition to perform the fan operation or the ventilation operation.

As a result, the air conditioning control apparatus 10 can cause the second indoor unit to perform the fan operation or the ventilation operation by using the automatic stop function.

(4-7) Modification 1G

The air conditioning control apparatus 10 may perform learning for determining the first indoor unit and the second indoor unit so as to reduce a total power consumption of the group GP1. The total power consumption of the group GP1 is, for example, a sum of power consumption of the indoor units 20*a* to 20*c* belonging to the group GP1. For example, the air conditioning control apparatus 10 uses, as the power consumption of the indoor units 20*a* and 20*b*, power consumption of the compressor 31*a* of the outdoor unit 30*a* distributed by the opening degrees of the indoor expansion valves 23*a* and 23*b*. For example, the air conditioning control apparatus 10 may determine the first indoor unit and the second indoor unit while performing deep reinforcement learning with the total power consumption of the group GP1 being reduced as a reward.

As a result, the air conditioning control apparatus 10 can improve the non-uniform temperature distribution in the target space SP and reduce the total power consumption of the group GP1.

(4-8) Modification 1H

The air conditioning control apparatus 10 may learn a start time of the cooling operation or the heating operation of the indoor units 20*a* to 20*c* belonging to the group GP1, and may automatically start the cooling operation or the heating operation before the predicted start time. For the learning, for example, a recursive neural network, a state space model, or the like is used.

As a result, the air conditioning control apparatus 10 can cause the thermal load to be processed in advance by automatically starting the cooling operation or the heating operation before the predicted start time.

(4-9) Modification 1I

The air conditioning control apparatus 10 may include a human detector as a functional block. The human detector detects a person in the target space SP by using human detection sensors 64*a* to 64*d*. When there is no person in the target space SP, the air conditioning control apparatus 10 causes at least one indoor unit belonging to the group GP1 to perform the fan operation or the ventilation operation to circulate the indoor air RA in the target space SP.

As a result, the air conditioning control apparatus 10 can improve the non-uniform temperature distribution in the target space SP by circulating the indoor air RA in the target space SP while there is no person in the target space SP.

(4-10) Modification 1J

The air conditioning control apparatus 10 may have a function of equalizing the set temperatures of the indoor units 20*a* to 20*c* belonging to the group GP1 if a predetermined condition is satisfied. For example, when the difference between a maximum value and a minimum value of measured values of the indoor temperature sensors 63*a* to 63*c* is larger than a predetermined value, the air conditioning control apparatus 10 sets the set temperatures of the indoor units 20*a* to 20*c* to an average value of the set temperatures. The predetermined value is, for example, 2° C.

As a result, the air conditioning control apparatus 10 can further improve the non-uniform temperature distribution in the target space SP by using both the function of equalizing the set temperatures of the indoor units 20*a* to 20*c* belonging to the group GP1 and the thermal load adjustment function.

(4-11)

The embodiment of the present disclosure has been described above. It will be understood that various changes to modes and details can be made without departing from the spirit and scope of the present disclosure recited in the claims.

REFERENCE SIGNS LIST

1: air conditioning system
10: air conditioning control apparatus
20*a* to 20*d*: indoor units
30*a*, 30*b*: outdoor unit
GP, GP1: group (indoor unit group)
SP: target space (space)
δT: temperature difference

CITATION LIST

Patent Literature

Patent Literature 1: JP H05-312378 A

The invention claimed is:

1. An air conditioning control apparatus comprising:

a memory including instructions stored thereon; and a processor configured to execute the instructions to control a plurality of indoor units, wherein the indoor units having been designated among the plurality of indoor units are set as an indoor unit group, the processor is configured to execute the instructions to causes a first indoor unit belonging to the indoor unit group to perform a cooling operation or a heating operation and causes a second indoor unit belonging to the indoor unit group to perform a fan operation or a ventilation operation when a difference of a certain level or more occurs in thermal loads to be processed by each of the indoor units belonging to the indoor unit group, the processor is configured to execute the instruction to switch the fan operation or the ventilation operation performed by the second indoor unit to the operation before the fan operation or the ventilation operation is performed when a difference of a certain level or more disappears in the thermal loads to be processed by each of the indoor units belonging to the indoor unit group, and the thermal load is a temperature difference between a set temperature and a room temperature of each of the indoor units belonging to the indoor unit group.

2. The air conditioning control apparatus according to claim 1, wherein the thermal load to be processed by the second indoor unit is smaller than the thermal load to be processed by the first indoor unit.

3. The air conditioning control apparatus according to claim 1, wherein the processor is configured to execute the instructions to automatically stop the cooling operation or the heating operation of the indoor unit in accordance with a set temperature, and the indoor unit to be automatically stopped is set as the second indoor unit.

4. The air conditioning control apparatus according to claim 1, wherein each of the indoor units belonging to the indoor unit group forms a refrigeration cycle together with an outdoor unit, and the processor is configured to execute the instructions to cause the first indoor unit to perform the cooling operation or the heating operation and cause the second indoor unit to perform the fan operation or the ventilation operation based on a basis of a condensation temperature or an evaporation temperature requested by each of the indoor units to each of the outdoor units to which the indoor units are respectively connected.

5. The air conditioning control apparatus according to claim 1, the processor is configured to execute the instructions to the second indoor unit to perform the fan operation or the ventilation operation with an air volume higher than an air volume during an operation before the fan operation or the ventilation operation is performed.

6. The air conditioning control apparatus according to claim 1, the processor is configured to execute the instructions to performing learning for determining the first indoor unit and the second indoor unit so as to reduce a total power consumption of the indoor unit group.

7. The air conditioning control apparatus according to claim 1, the processor is configured to execute the instructions to perform learning a start time of the cooling operation or the heating operation of the indoor units belonging to the indoor unit group and automatically starting the cooling operation or the heating operation before a predicted start time.

8. The air conditioning control apparatus according to claim 1, further comprising a human detector configured to detects a person in a space, wherein the processor is configured to execute the instructions to causes at least one indoor unit belonging to the indoor unit group to circulate air in the space when there is no person in the space.

9. An air conditioning system comprising:

the air conditioning control apparatus according to claim 1; and the plurality of indoor units.

10. The air conditioning control apparatus according to claim 1, wherein the processor is configured to execute the instructions to automatically stop the cooling operation or the heating operation of the indoor unit in accordance with the set temperature, and the indoor unit to be automatically stopped is set as the second indoor unit.

11. The air conditioning control apparatus according to claim 2, wherein the processor is configured to execute the instructions to automatically stop the cooling operation or the heating operation of the indoor unit in accordance with a set temperature, and the indoor unit to be automatically stopped is set as the second indoor unit.

12. The air conditioning control apparatus according to claim 2, wherein each of the indoor units belonging to the indoor unit group forms a refrigeration cycle together with an outdoor unit, and the processor is configured to execute the instructions to cause the first indoor unit to perform the cooling operation or the heating operation and cause the second indoor unit to perform the fan operation or the ventilation operation based on a condensation temperature or an evaporation temperature requested by each of the indoor units to each of the outdoor units to which the indoor units are respectively connected.

13. The air conditioning control apparatus according to claim 3, wherein each of the indoor units belonging to the indoor unit group forms a refrigeration cycle together with an outdoor unit, and the processor is configured to execute the instructions to cause the first indoor unit to perform the cooling operation or the heating operation and cause the second indoor unit to perform the fan operation or the ventilation operation based on a condensation temperature or an evaporation temperature requested by each of the indoor units to each of the outdoor units to which the indoor units are respectively connected.

14. The air conditioning control apparatus according to claim 2, the processor is configured to execute the instructions to cause the second indoor unit to perform the fan operation or the ventilation operation with an air volume higher than an air volume during an operation before the fan operation or the ventilation operation is performed.

15. The air conditioning control apparatus according to claim 3, the processor is configured to execute the instructions to cause the second indoor unit to perform the fan operation or the ventilation operation with an air volume higher than an air volume during an operation before the fan operation or the ventilation operation is performed.

* * * * *